US006794820B1

(12) United States Patent
Kang et al.

(10) Patent No.: US 6,794,820 B1
(45) Date of Patent: Sep. 21, 2004

(54) PLASMA DISPLAY PANEL WITH SHAPED DIELECTRIC PATTERNS

(75) Inventors: Jung Won Kang, Seoul (KR); Oe Dong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 333 days.

(21) Appl. No.: 09/585,444

(22) Filed: Jun. 2, 2000

(30) Foreign Application Priority Data

Jun. 3, 1999 (KR) ..... 99-20550
Jun. 12, 1999 (KR) ..... 99-21877
Nov. 18, 1999 (KR) ..... 99-51212

(51) Int. Cl.[7] ..... H01J 1/16; H01J 17/49; H01J 17/00

(52) U.S. Cl. ..... 313/586; 313/336; 313/583; 313/584; 313/585; 313/586; 313/587; 313/590

(58) Field of Search ..... 313/336, 583, 313/584, 585, 586, 587, 590

(56) References Cited

U.S. PATENT DOCUMENTS 4,999,541 A * 3/1991 Kim et al. ..... 313/584
5,825,128 A * 10/1998 Betsui et al. ..... 313/485
6,340,866 B1 * 1/2002 Yoo ..... 313/484
6,414,435 B1 * 7/2002 Akiba ..... 313/584

FOREIGN PATENT DOCUMENTS

JP 4048534 2/1992 ..... H01J/17/49
JP 11312470 11/1999 ..... H01J/11/01

OTHER PUBLICATIONS

Japanese Search Report.

* cited by examiner

*Primary Examiner*—Ashok Patel
*Assistant Examiner*—Matt Hodges
(74) *Attorney, Agent, or Firm*—Fleshner & Kim, LLP

(57) ABSTRACT

A radio frequency plasma display panel that is capable of reducing a discharge voltage. In the plasma display panel, a dielectric material is entirely coated on a substrate and is patterned to have a convex surface. A first electrode crossing the dielectric pattern is formed on the substrate, and a dielectric layer is entirely coated on the substrate provided with the dielectric pattern and the first electrode. A second electrode crossing the first electrode is formed on a concave groove area in the dielectric layer having a wave shape with lands and grooves.

17 Claims, 10 Drawing Sheets

PLASMA DISPLAY PANEL WITH SHAPED DIELECTRIC PATTERNS

BACKGROUND OF THE INVENTION

1. Field of the Invention

This invention relates to a plasma display panel, and more particularly to a plasma display panel driven with a radio frequency that is adapted to reducing a discharge voltage as well as a leakage current between electrodes. Also, the present invention is directed to a method of fabricating the same.

2. Description of the Related Art

Generally, a plasma display panel (PDP) radiates a fluorescent body by an ultraviolet with a wavelength of 147 nm generated during a discharge of He+Xe or Ne+Xe gas to thereby display a picture including characters and graphics. Such a PDP is easy to be made into a thin film and large-dimension type. Moreover, the PDP provides a very improved picture quality owing to a recent technical development. The PDP is largely classified into a direct current (DC) driving system and an alternating current (AC) driving system. Since the AC-type PDP has an advantage of a low voltage driving and a long life in comparison to the DC-type PDP, it will be highlighted as the future display device. The AC-type PDP allows an alternating voltage signal to be applied between electrodes having dielectric layer therebetween to generate a discharge every half-period of the signal, thereby displaying a picture. Such an AC-type PDP uses a dielectric material that allows a wall charge to be accumulated on the surface thereof upon discharge.

Referring to FIG. 1, the AC-type PDP includes a front substrate 1 provided with a sustaining electrode pair 10, and a rear substrate 2 provided with address electrodes 4. The front substrate 1 and the rear substrate 2 are spaced in parallel to each other with having a barrier rib 3 therebetween. A mixture gas, such as Ne–Xe or He–Xe, etc., is injected into a discharge space defined by the front substrate 1, the rear substrate 2 and a barrier rib 3. The sustaining electrode pair 10 makes a pair by two within a single of plasma discharge channel. Any one of the sustaining electrode pair 10 is used as a scanning/sustaining electrode that responds to a scanning pulse applied in an address interval to cause an opposite discharge along with the address electrode 4 while responding to a sustaining pulse applied in a sustaining interval to cause a surface discharge with the adjacent sustaining electrodes 10. Also, the sustaining electrode 10 adjacent to the sustaining electrode used as the scanning/sustaining electrode is used as a common sustaining electrode to which a sustaining pulse is applied commonly. On the front substrate 1 provided with the sustaining electrodes 10, a dielectric layer 8 and a protective layer 9 are disposed. The dielectric layer a is responsible for limiting a plasma discharge current as well as accumulating a wall charge during the discharge. The protective film 9 prevents a damage of the dielectric layer 8 caused by the sputtering generated during the plasma discharge and improves the emission efficiency of secondary electrons. This protective film 9 is usually made from MgO. At the rear substrate 2, a dielectric thick film 6 covering the address electrodes 4 is formed and barrier ribs 3 for dividing the discharge space are extended perpendicularly. On the surfaces of the rear substrate 2 and the barrier ribs 3, a fluorescent material excited by a vacuum ultraviolet lay to generate a visible light is provided.

In such an AC-type PDP, one frame consists of a number of sub-fields so as to realize gray levels by a combination of the sub-fields. For instance, when it is intended to realize 256 gray levels, one frame interval is time-divided into 8 sub-fields Further, each of the 8 sub-fields is again divided into a reset interval, an address interval and a sustaining interval. The entire field is initialized in the reset interval. Cells on which a data is to be displayed are selected by the address discharge in the address interval. The selected cells sustain the discharge in the sustaining interval. The sustaining interval is lengthened by an interval corresponding to $2^n$ depending on a weighting value of each sub-field. In other words, the sustaining interval involved in each of the first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. The brightness and the chrominance of a displayed image are determined in accordance with a combination of the sub-fields.

In the AC-type PDP, a sustaining pulse having a duty ratio of 1, a frequency of 200 to 30 kHz and a pulse width of 10 to 20 $\mu$s is alternately applied to the sustaining electrode pair 10. The sustaining discharge occurring between the sustaining electrode pair 10 in response to the sustaining pulse is generated only once at an extremely short instance. Charged particles produced by the sustaining discharge moves through a discharge path between the sustaining electrode pair 10 in accordance with the polarity of the sustaining electrode pair 10 to be accumulated on an upper dielectric layer 14 and thus be left into a wall charge. This wall charge lowers a driving voltage during the next sustaining discharge, but it reduces an electric field at a discharge space during the present sustaining discharge. Thus, if a wall charge is formed during the sustaining discharge, then a discharge is stopped. As mentioned above, the sustaining discharge is generated only once at a much shorter instance than a width of the sustaining pulse, and the majority of sustaining discharge time is wasted for a preparation step for the wall charge formation and the next sustaining discharge. For this reason, since the conventional AC-type PDP has a much shorter real discharge interval than the entire discharge interval, it has a low brightness and low discharge efficiency.

In order to solve the above-mentioned low brightness and discharge efficiency problem in the AC-type PDP, there has been suggested a radio frequency PDP, hereinafter referred to as "RFPDP", for exploiting a radio frequency signal of tens of to hundreds of MHz to cause the sustaining discharge. In the RFPDP, electrons make a vibrating motion within the cell by the radio frequency discharge.

Referring to FIG. 2, the RFPDP includes a rear substrate 12 formed in such a manner that an address electrode 14 is perpendicular to the scanning electrode 18, and a rear substrate 30 formed in such a manner that a radio frequency electrode 28 is parallel to the scanning electrode 18. Between the address electrode 14 and the scanning electrode 18, a first lower dielectric layer 16 for insulation between these electrodes is provided. A second lower dielectric layer 20 and a protective film 22 are disposed on the scanning electrode 18. An upper dielectric layer 29 is formed evenly on the rear substrate provided with the radio frequency electrode 28, and a rectangular barrier rib 24 is formed thereon. The surface of the rectangular barrier rib 24 is coated with a fluorescent material 26.

The RFPDP displays a picture by a combination of a number of sub-fields each of which includes a reset interval, an address interval and a sustaining interval. In the reset interval, the entire field is initialized. Next, in the address interval, cells are selected by a discharge between the address electrode 14 and the scanning electrode 18. The selected cells displays a picture by the vibration motion of electrons in the sustaining interval. At this time, a radio frequency signal of several to tens of MHz is applied to the radio frequency electrode 28, and a desired level of direct current bias voltage is applied to the scanning electrode. By this radio frequency signal, electrons within the cells make a vibration motion within the discharge space in accordance with the polarity of the radio frequency signal. The vibration motion of electrons successively ionizes a discharge gas. A vacuum ultraviolet ray generated by such a discharge excites a fluorescent material 26 to generate a visible light upon transition of the fluorescent material 26. As described above, the RFPDP exploits a radio frequency signal to cause a discharge continuously during the sustaining interval, so that it can obtain higher brightness and higher discharge efficiency in comparison to the AC-type PDP.

Since the thickness of the dielectric layers 16 and 20 disposed on the rear substrate 12 determines a writing voltage required upon address discharge and a leakage current between electrodes, it must be designed appropriately. The dielectric layers 16 and 20 have a larger thickness than the dielectric thick film 6 in the conventional AC-type PDP. When the dielectric layers have a large thickness, a writing voltage applied between the address electrode 14 and the scanning electrode 18 during the address discharge is lowered because a voltage drop is caused by the dielectric layers 16 and 20. Thus, an unstable address discharge is generated. If a writing voltage is raised for the purpose of stabilizing the address discharge, then a driving circuit must be implemented with high voltage circuit devices to cause a rise of the manufacturing cost as well as the power consumption. A writing voltage required for the address discharge will be calculated below.

A capacitance C accumulated in the dielectric layers 16 and 20 is given by the following equation:

$$c = \frac{\varepsilon_r \varepsilon_o A}{d} \tag{1}$$

wherein $\epsilon_r$ $\epsilon_0$ represents a dielectric constant, A does an area of the dielectric layers 16 and 20, and d does a thickness of the dielectric layers 16, and 20. Assuming that C1 is a capacitance between the scanning electrode 18 and the discharge space 32, C2 is a capacitance formed on a discharge path of a discharge space 32, and C3 is a capacitance between the discharge space 32 and the address electrode 14 as shown in FIG. 3, the magnitude of C1, C2 and C3 is reduced in turn as given by the following equation:

$$c1 : c2 : c3 = \frac{10\varepsilon_o A}{30} : \frac{1\varepsilon_o A}{10} : \frac{1\varepsilon_o A}{70} \approx 0.33 : 0.05 : 0.14 \tag{2}$$

In the above equation (2), it has been assumed that a thickness d between the dielectric layers 16 and 20 between the scanning electrode 18 and the discharge space 32 is 30 $\mu$m, a thickness d of the dielectric layers 16 and between the address electrode 14 and the discharge space 32 is 70 $\mu$m, and a thickness of the discharge space 32 provided with C2 is 20 $\mu$m. Also, it has been assumed that each area A of C1 to C3 is constant. It is assumed that an electric constant $\epsilon_r$ $\epsilon$ of the dielectric layers 16 and 20 is 10 while an electric constant $\epsilon_r$ $\epsilon$ of the discharge space 32 is 1.

It can be seen from the above equation (2) that the relationship of a capacitance C2 of the discharge space 32 to a capacitance C1+C3 of the dielectric layers 16 and becomes 0.1:0.05. Assuming that a writing voltage applied between the scanning voltage 18 and the address electrode 14 is Vwrt, a voltage vdi applied to the dielectric layers 16 and 20 is given by the following equation:

$$Vdi = \frac{0.05}{0.1 + 0.05} Vwrt \tag{3}$$

Accordingly, 30% to 40% of the writing voltage applied between the scanning electrode 18 and the address electrode 14 is applied to the dielectric layers 16 and 20. As a result, if a voltage capable of causing the address discharge is 200V, then a writing voltage required for the scanning electrode 18 and the address electrode 14 must be raised into at least 290V to 330V.

Since the thickness of the dielectric layers 16 and 20 is more than 30 to 40 $\mu$m, a screen printing process for coating a dielectric material on the substrate 12 must be repeatedly carried out several times. The interface characteristic and thickness of the dielectric layers 16 and 20 coated on the substrate 12 in this manner is liable to be non-uniform due to the repetition of the screen printing. In this case, owing to the thickness non-uniformity of the dielectric layers 16 and 20, a writing voltage applied between the scanning electrode 14 and the address electrode 18 becomes non-uniform.

If the dielectric layer 16 existing between the scanning electrode 18 and the address electrode is formed to have a small thickness, then a leakage current ileak between scanning electrode 18 and the address electrode 14 increase to such an extent that the thickness of the dielectric layer 16 is reduced. This can be seen from the above equation (1) and the following equation:

$$ileak = C\frac{dv}{dt} \tag{4}$$

SUMMARY OF THE INVENTION

Accordingly, it is an object of the present invention to provide a radio frequency plasma display panel that is capable of lowering a discharge voltage and a fabrication method thereof.

A further object of the present invention is to provide a radio frequency plasma display panel that is capable of reducing a leakage current between electrodes and a fabrication method thereof.

In order to achieve these and other objects of the invention, a radio frequency plasma display panel according to one aspect of the present invention includes a plurality of dielectric patterns formed on a substrate to have a convex surface; a first electrode formed an the dielectric patterns and the substrate; a second electrode for causing a discharge along with the first electrode; and a dielectric layer provided between the first and second electrodes to make an insulation between the first and second electrodes.

A radio frequency plasma display panel according to another aspect of the present invention includes a first electrode formed on a substrate; a second electrode crossing the first electrode to cause a discharge along with the first electrode; and a dielectric pattern, being patterned between the first and second electrodes to have a desired shape, for making an insulation between the first and second electrodes.

A method of fabricating a radio frequency plasma display panel according to still another aspect of the present invention includes the steps of entirely coating a dielectric material on a substrate; patterning the dielectric material to have a convex surface; forming a first electrode crossing the dielectric pattern on the substrate; entirely coating a dielectric layer on the substrate provided with the dielectric pattern and the first electrode; and forming a second electrode on a concave groove area in the dielectric layer having a wave shape with lands and grooves in such a manner to cross the first electrode.

A method of fabricating a radio frequency plasma display panel according to still another aspect of the present invention includes the steps of forming a first electrode on a substrate; entirely coating a dielectric material on the substrate provided with the first electrode; patterning the dielectric material to have a desired shape; and forming a second electrode on the substrate in such a manner to cross the first electrode with having the dielectric pattern therebetween.

BRIEF DESCRIPTION OF THE DRAWINGS

These and other objects of the invention will be apparent from the following detailed description to the embodiments of the present invention with reference to the accompanying drawings, in which.

DETAILED DESCRIPTION OF THE PREFERRED EMBODIMENT

Figure 4:
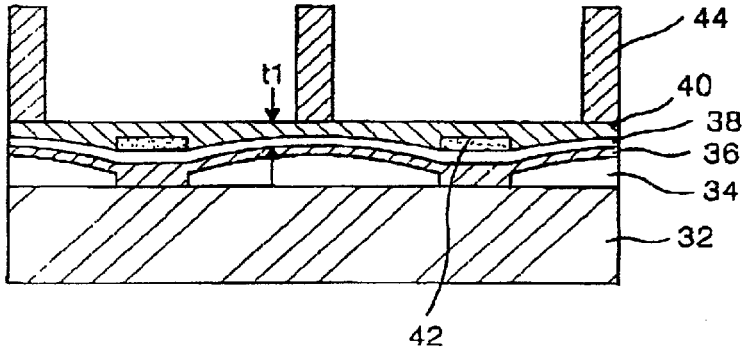
FIG. 4 is a sectional view showing the structure of a lower plate of a radio frequency plasma display panel according to a first embodiment of the present invention.

Referring to FIG. 4, there is shown a radio frequency plasma display panel (RFPDP) according to an embodiment of the present invention. The RFPDP includes dialectic patterns 34, an address electrode 36 and a first lower dielectric layer 38 that are disposed on a rear substrate 32, and a scanning electrode 42 crossing the address electrode 36 oh the first lower dielectric layer 38. Each of the dielectric patterns 34 is thin at each side thereof and is convex at the center thereof. These dielectric patterns 34 are patterned in a stripe shape on the rear substrate 32 in such a manner to be spaced by a desired distance. The address electrode 36 is formed into a uniform thickness on the tear substrate 32 provided with the dielectric patterns 34. Thus, the address electrode 36 is formed into a wave shape having lands and grooves. The first lower dielectric layer 38 coves the address electrode 36. The groove portion of the first lower dielectric layer 38 has a gentler slope than the groove portion of the address electrode 36. The scanning electrode 42 is formed on the gentle groove portion of the first lower dielectric layer 38 to be perpendicular to the address electrode 36. The second lower dielectric layer 40 is formed on the first lower dielectric layer 38 in such a manner to have an even surface and covers the scanning electrode 42. The thickness t1 of the first and second lower dielectric layers 38 and 40 covered on the land portion of the address electrode 36 is thinner than that of the dielectric layers 16 and 20 shown in FIG. 2. Since a voltage loss is reduced to such an extent that the lower dielectric layers 38 and 40 become thin, a voltage level of a writing voltage applied between the address electrode 36 and the scanning electrode 42 can be lowered.

Figure 1:
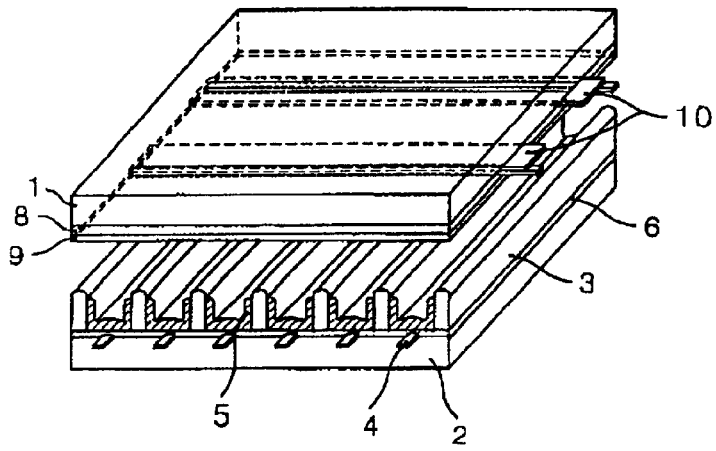
FIG. 1 RELATED ART
FIG. 1 is a perspective view showing the structure of a conventional AC-type plasma display panel.
Figure 2:
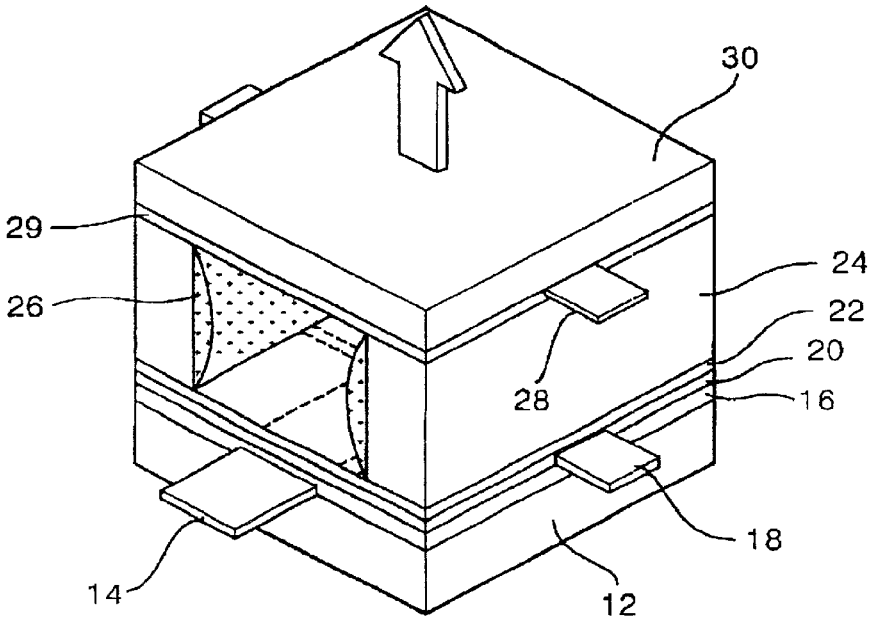
FIG. 2 RELATED ART
FIG. 2 is a perspective view showing the structure of a conventional radio frequency plasma display panel.
Figure 3:
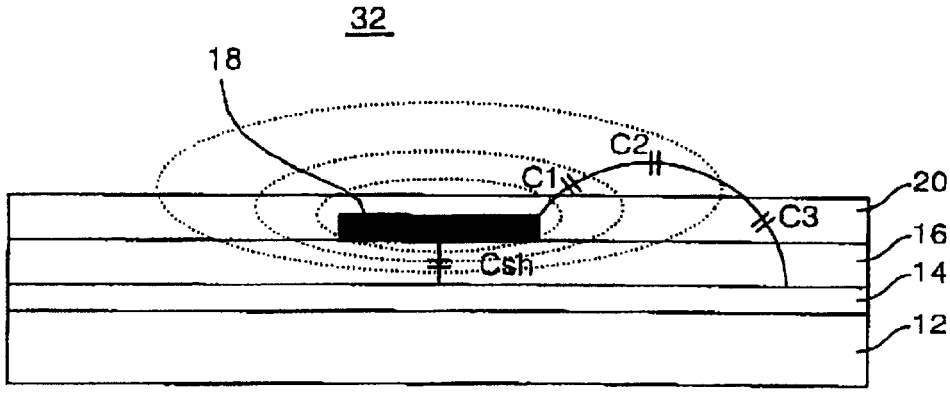
FIG. 3 RELATED ART
FIG. 3 is a schematic sectional view of the lower dielectric layers shown in FIG. 2 and a capacitor formed within a discharge space.

An upper plate joined with the lower plate as described above has a structure identical substantially to that shown in FIG. 2. In other words, a front substrate of the upper plate (not shown) is provided with radio frequency electrodes and dielectric layers. Accordingly, a diffusion of charged particles or electric charges between the adjacent discharge cells during the discharge is shut off with the aid of barrier ribs 44 to prevent a cross talk between the adjacent discharge cells.

Figure 5A:
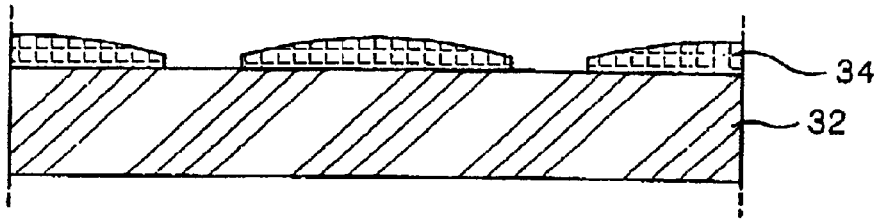
FIG. 5A to FIG. 5E are sectional views for representing a method of fabricating the lower plate of the radio frequency plasma display panel shown in FIG. 4 step by to step.
Figure 5B:
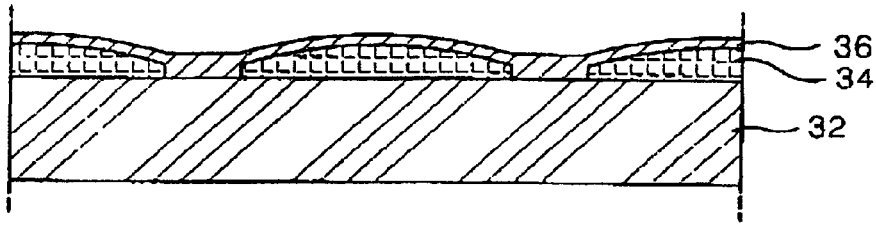
Figure 5C:
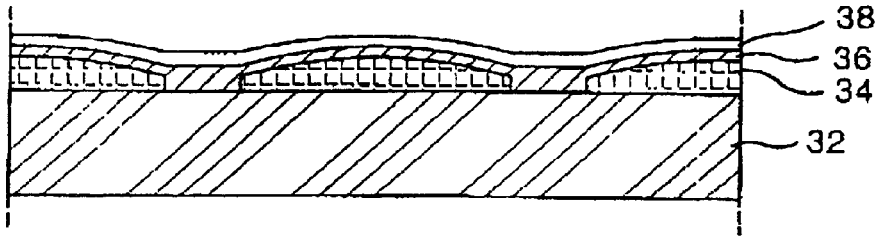
Figure 5D:
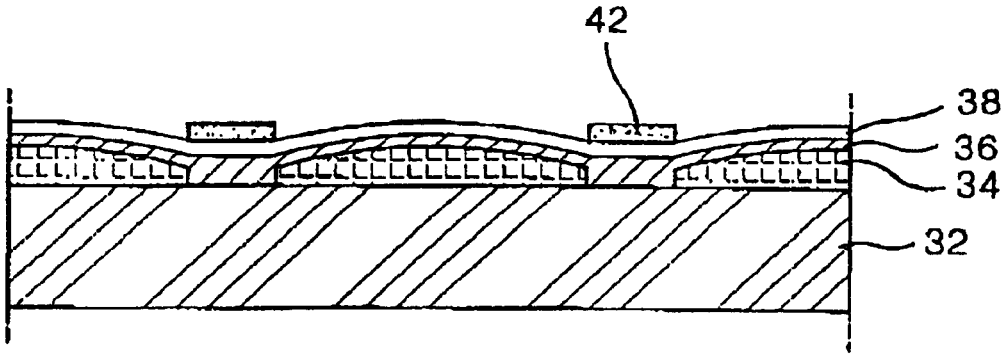
Figure 5E:
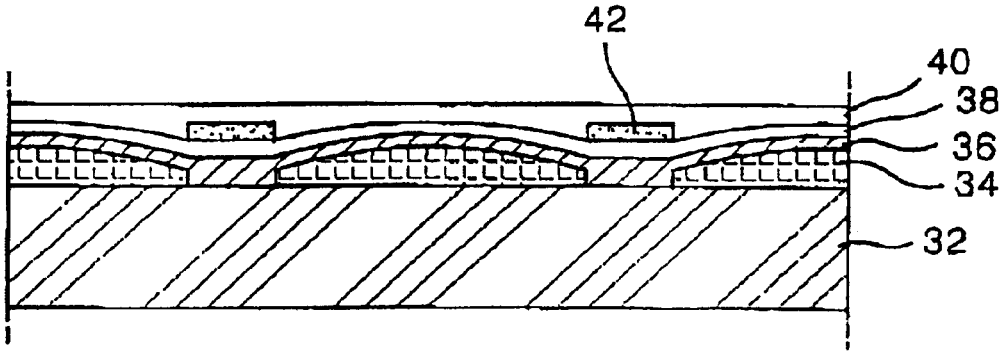

FIGS. 5A to 5E shows a method of fabricating the lower plate of the RFPDP in FIG. 4. Referring to FIG. 5A, the dielectric patterns 34 are formed on the rear substrate 32. The dielectric patterns 34 is formed by repeating the screen printing process using a mask pattern patterned in a stripe shape. Upon coating, the center portion of a dielectric material is patterned into a convex shape with each edge portion thereof being collapsed. As shown in FIG. 5B, the address electrode 36 is formed on the lower substrate 32 provided with the dielectric patterns 34. The address electrode 36 is deposited on the rear substrate 32 using the vacuum vapor deposition, such as the sputtering, in such a manner to cross the dielectric patterns 34. The address electrode 36 formed in this manner has lands and grooves from a wave shape made by the dielectric patterns 34 and the surface of the rear substrate 32. As shown in FIG. 5C, the dielectric material is entirely coated on the rear substrate 32 using the screen printing process to cover the address electrode 36, thereby forming the first lower dielectric layer 38. The first lower dielectric layer 38 is formed into a wave shape having lands and grooves in similarity to the dielectric patterns 34. Since the dielectric material flows into the groove portion during the screen printing, the groove of the first lower dielectric layer 38 is gentler than that of the address electrode 36. The groove portion of the first lower dielectric layer 38 is provided with the scanning electrodes 42 in such manner that the scanning electrode crosses the address electrode 36 as shown in FIG. 5D. The scanning electrodes 42 are formed by the vacuum vapor deposition such as the sputtering. Finally, as shown in FIG. 5E, the second lower dielectric layer 40 is evenly coated to cover the scanning electrodes 42. At this time, the dielectric material is entirely coated on the rear substrate 32 provided with the scanning electrodes 42 by the screen printing or the spin coating. On the second lower dielectric layer 40, lattice-shape barrier ribs 44 are formed in such a manner that the left and right sides thereof correspond to the convex center portions of the dielectric patterns 34 as shown in FIG. 4. The surfaces of the barrier ribs 44 are coated with a fluorescent material. After the lower plate is completed in this manner, the upper plate provided with the radio frequency electrodes and the dielectric layers, etc. is joined with the lower plate on the front substrate (not shown), and a discharge gas is injected into the inner discharge space.

Figure 6:
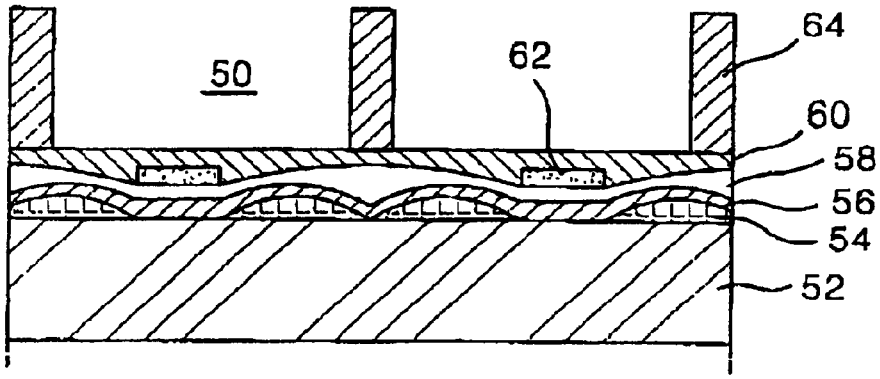
FIG. 6 is a sectional view showing the structure of a lower plate of a radio frequency plasma display panel according to a second embodiment of the present invention.

FIG. 6 shows a lower plate of a RFPDP according to a second embodiment of the present invention. Referring to FIG. 6, the RFPDP includes dielectric patterns 54 arranged at a desired space, two by two, every discharge cell 50. The dielectric pattern 54 has a width reduced into about a half in comparison to that shown in FIG. 4. At the boundary of the discharge cell 50, two dielectric patterns 54 are adjacent to each other. On such dielectric patterns 54, address electrodes 56 are formed in such a manner to cross the dielectric patterns 54 having lands and grooves.

A first lower dielectric layer 58 is entirely coated on the dielectric patterns 54 and the address electrodes 56. Scanning electrodes 62 are formed in such a manner to cross the address electrodes 56 at the grooves of the first lower dielectric layer 58. A second lower dielectric layer 60 is formed on the first lower dielectric layer 58 and the scanning electrodes 62, and a protective film (not shown) and barrier ribs are formed thereon.

The thickness t2 of the lower dielectric layers 58 and 60 positioned at each side of the scanning electrode 62 and formed on the land of the address electrode 56 becomes thinner than that of the prior art. Thus, when a writing voltage is applied between the address electrode 56 and the scanning electrode 62, a voltage loss caused by a dielectric material is reduced. Also, as the land of the address electrode 56 positioned at each side of the scanning electrode 62 has a height similar to the scanning electrode 62, a discharge distance between these two electrodes 56 and 62 is reduced to that extent. Since the discharge distance is a distance between the side edge of the scanning electrode 62 and the land of the address electrode 56, it can be reduced by an appropriate size design of the dielectric patterns 54. As described above, if the discharge distance between the two electrodes 56 and 62 is reduced, a voltage required for the discharge can be reduced to that extent to thereby lower a writing voltage applied to the address electrode 56.

Since a method of fabricating the lower plate of the RFPDP as shown in FIG. 6 is substantially identical to the method shown in FIGS. 5A to 5E except that a mask pattern for forming the dielectric patterns 54 is different from each other, a detailed explanation as to the method has been omitted.

Figure 7:
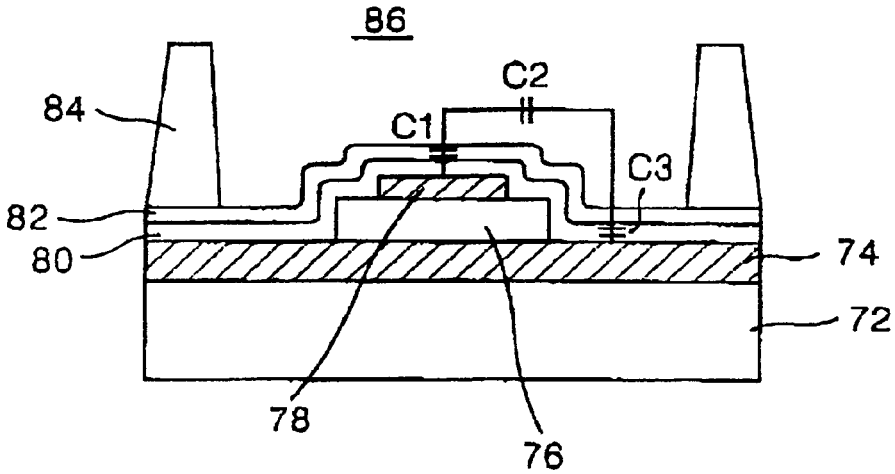
FIG. 7 is a sectional view showing the structure of a lower plate of a radio frequency plasma display panel according to a third embodiment of the present invention.

FIG. 7 shows a lower place of a RFPDP according to a third embodiment of the present invention. Referring to FIG. 7, the RFPDP includes an address electrode 74 and a scanning electrode 78 that crosses each other on a rear substrate 72, a dielectric pattern 76 provided at an intersection between the address electrode 74 and the scanning electrode 78, and a lower dielectric layer 80 coated entirely on the rear substrate 72. The dielectric pattern 46 has a stripe shape or a line shape, and is formed in a direction perpendicular to the address electrode 74 to serve as an insulating layer between the address electrode 74 and the scanning electrode 78. The scanning electrode 78 is formed along the dielectric pattern 76 thereon. The lower dielectric layer 80 covers the address electrode 74, the dielectric pattern 76 and the scanning electrode 75. A protective film 82 is entirely formed on the lower dielectric layer 80, and barrier ribs 84 are formed on the protective film 82.

Since the dielectric pattern 76 is formed in a line shape along the scanning electrode 78, the thickness of the dielectric layer 80 covered on the address electrode 74 and the scanning electrode 78 becomes thin. The thickness of the dielectric layer 80 covered on the address electrode 74 and the scanning electrode 78 becomes thin, so that it is possible to lower a voltage required for a discharge between the address electrode 74 arid the scanning electrode 78.

Assuming that C1 is a capacitance between the scanning electrode 78 and a discharge space 86, C2 is a capacitance formed in a discharge path of the discharge space 86, and C3 is a capacitance between the discharge space 86 and the address electrode 74, magnitudes of C1 to C3 are given by the following equation:

$$c1 : c2 : c3 = \frac{10\varepsilon_o A}{20} : \frac{1\varepsilon_o A}{60} : \frac{10\varepsilon_o A}{20} \approx 0.5 : 0.016 : 0.5 \tag{5}$$

In the above equation (5), it is assumed that the thickness d of the dielectric material 80 plus the protective film 92 between the scanning electrode 78 and the discharge space 86 is 20 $\mu$m, a distance or thickness d of the discharge space 86 forming C2 is 60 $\mu$m, and the thickness of the dielectric material 80 plus the protective film 82 between the address electrode 74 and the scanning electrode 78 is 20 $\mu$m. Also, it is assumed that an area A of capacitors forming C1, C2 and C3 is constant. A distance of C2 formed within the discharge space 82 can be adjusted by a width control of the dielectric pattern 76.

It can be seen from the above equation (5) that the relationship of a capacitance C2 formed within the discharge space 82 to a capacitance C1+C3 formed in the dielectric layers 80 and the protective film 82 becomes 0.25:0.016. Assuming that a writing voltage applied between the scanning voltage 78 and the address electrode 74 is Vwrt, a voltage vdi applied to the dielectric layers 80 and the protective film 82 is given by the following equation:

$$Vdi = \frac{0.016}{0.25 + 0.016} Vwrt \tag{6}$$

As seen from the above equation (6), more than 90% of the writing voltage applied between the scanning electrode 78 and the address electrode 74 is applied to the discharge space 86. As a result, if a voltage capable of causing the address discharge is 200V, then about 220V is sufficient for a writing voltage required for the scanning electrode 78 and the address electrode 74.

Figure 8A:
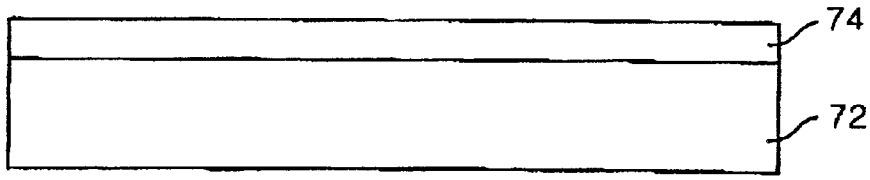
FIG. 8A to FIG. 8E are sectional views for representing a method of fabricating the lower plate of the radio frequency plasma display panel shown in FIG. 7 step by step.
Figure 8B:
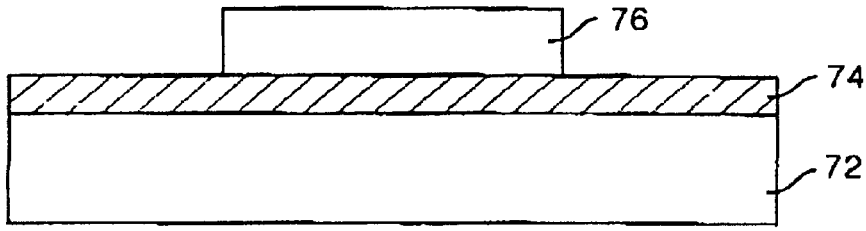
Figure 8C:
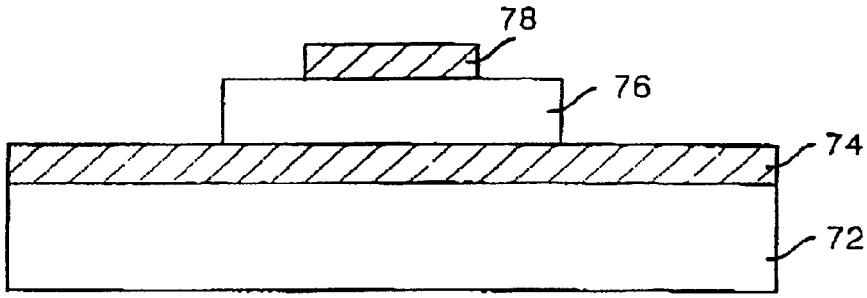
Figure 8D:
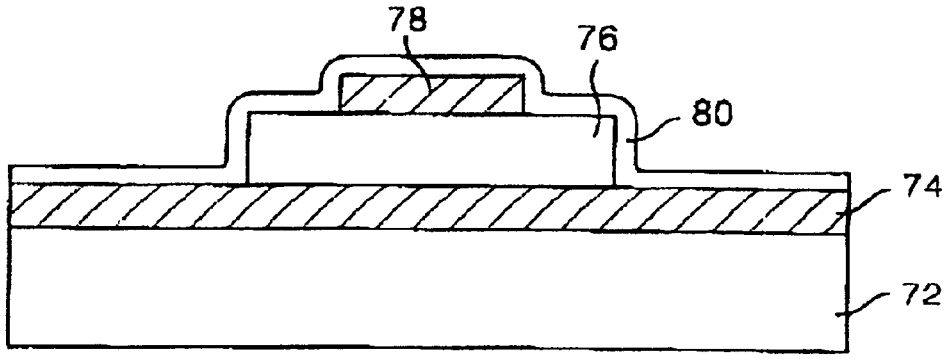
Figure 8E:
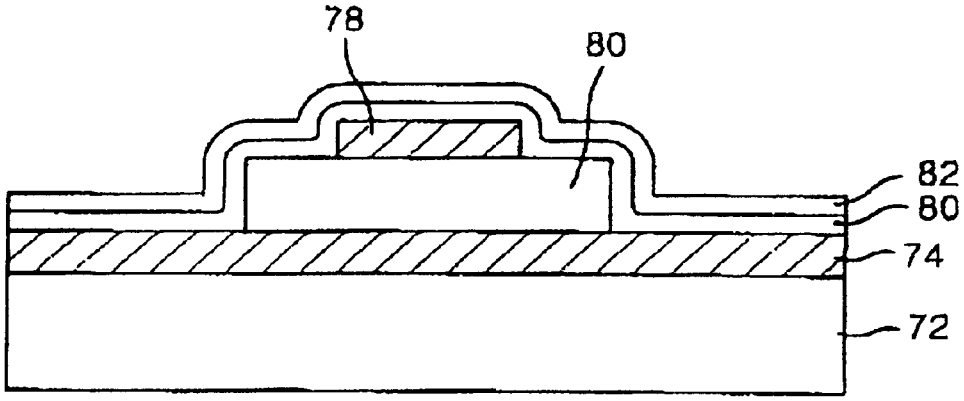

FIGS. 8A to 8E shows a method of fabricating a lower plate of the RFPDP in FIG. 7. Referring to FIG. 8A, the address electrode 74 is formed on the rear substrate 72 using the vapor deposition technique such as the sputtering. Subsequently, as shown in FIG. 8B, the dielectric pattern 76 is formed in such a manner to be perpendicular to the address electrode 74. The dielectric pattern 76 is patterned in a line shape by aligning a mask pattern patterned in a line shape on the rear substrate and thereafter printing a dielectric paste using the screen printing technique. On the dielectric pattern 76, as shown in FIG. 8C, the scanning electrode 78 is formed along the dielectric pattern 76 using the vapor deposition technique such as the sputtering. After the scanning electrode 78 was formed on the rear substrate 72, as shown in FIG. 8D, a dielectric material is coated on the entire surface of the rear substrate 72 using the screen printing technique to form the lower dielectric layer 80.

Since the dielectric pattern 76 and the lower dielectric layer 80 are coated on the rear substrate 72 once or twice by the screen printing technique, the interface characteristic and thickness of the dielectric pattern 76 and the lower dielectric layer 80 for all cells become uniform.

Accordingly, a variation amount in a writing voltage caused by the thickness non-uniformity of the dielectric pattern 76 and the lower dielectric layer 80 is minimized, so that almost same writing voltage can be applied to all cells. The protective film 82 is deposited on the rear substrate 72 provided with the lower dielectric layer 82 to have a uniform thickness.

The lower plate structure of the RF PDP as described above is capable of thinning a thickness of the dielectric layer 80 existing in the discharge path to lower a writing voltage as well as thickening a thickness of the dielectric pattern 76 existing between the address electrode 74 and the scanning electrode 78 to reduce a leakage current between the electrodes. However, a gap may be generated between the barrier rib 84 and the rear substrate 72 due to a protrusion in which the dielectric pattern 76 exists. Really, when the barrier rib 84 is joined with the rear substrate 72 after the barrier rib 84 was molded into a lattice shape in advance, a gap can exist between the barrier rib 84 and the rear substrate 72 due to a level difference between the barrier rib 84 and the dielectric pattern 76. Since charged particles or electric charges generated during the discharge can move between the adjacent cells through the gap, electrical and optical interference between the cells may be caused.

Figure 9:
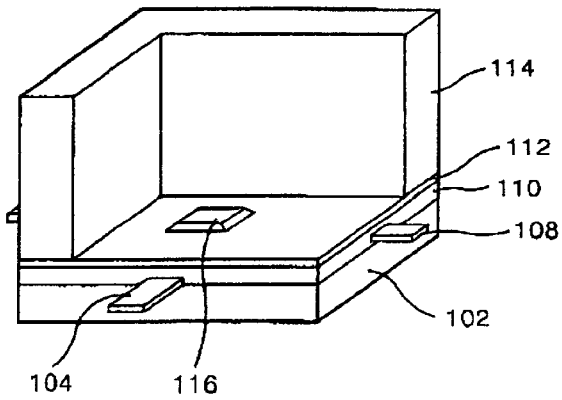
FIG. 9 is a sectional view showing the structure of a lower plate of a radio frequency plasma display panel according to a fourth embodiment of the present invention.
Figure 10:
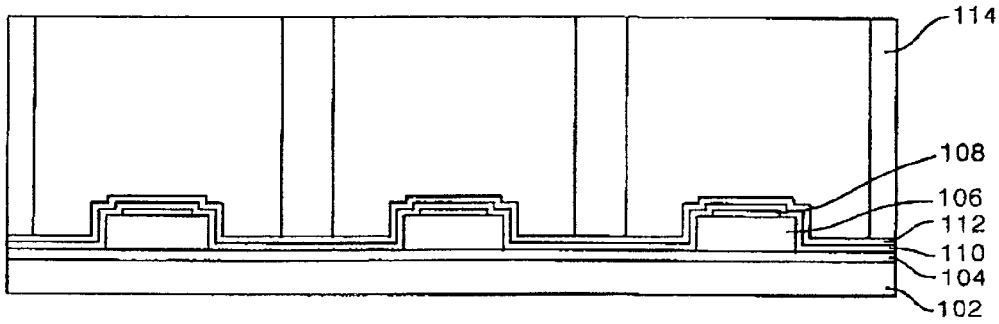
FIG. 10 is a sectional view of the radio frequency plasma display panel shown in FIG. 9.

FIG. 9 and FIG. 10 shows a lower plate of the RF PDP according to a fourth embodiment of the present invention. Referring to FIG. 9 and FIG. 10, the RFPDP includes a dielectric pattern 106 patterned in an island shape at an intersection between an address electrode 104 and a scanning electrode 108. The dielectric pattern 106 plays a role to make an insulation between the address electrode 104 and the scanning electrode 108. The thickness of the dielectric pattern 106 can be adjusted to minimize a leakage current between the address electrode 104 and the scanning electrode 108. A lower dielectric layer 110 and a protective film 112 are disposed on the dielectric pattern 106 and the electrodes 104 and 108, and a lattice-shape barrier rib 114 is joined thereon. Since the dielectric pattern 106 is limited to the center of the cell, that is, to the address electrode 104 and the scanning electrode 108, the thickness of the dielectric layer 110 existing in the discharge path becomes thin. Accordingly, a writing voltage can be reduced during the address discharge. The center of the protective film 112 is protruded by the thickness of the dielectric pattern 106. This protrusion 116 is spaced at a desired distance from the barrier rib 114, so that a level difference does not exist in the surface of the rear substrate 102 joined with the barrier rib 114.

Figure 11A:
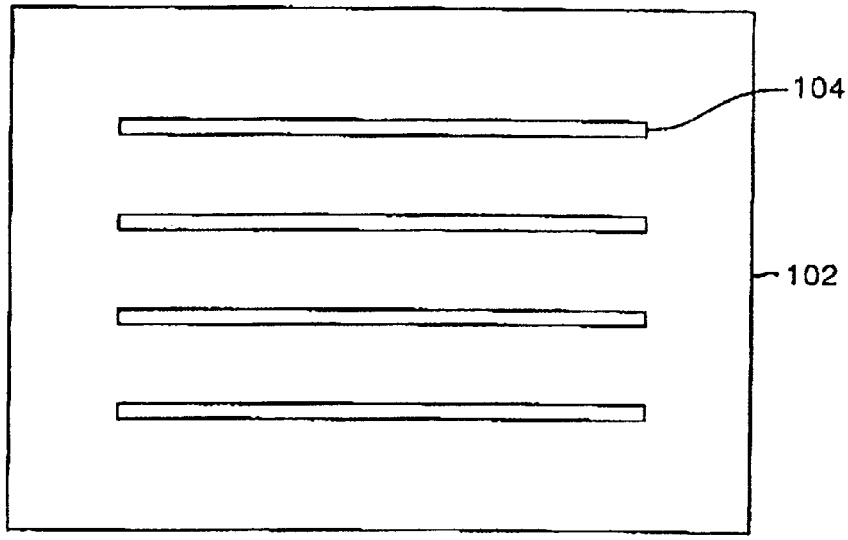
FIG. 11A to FIG. 11D are sectional views for representing a method of fabricating the lower plate of the radio frequency plasma display panel shown in FIG. 9 step by step.
Figure 11B:
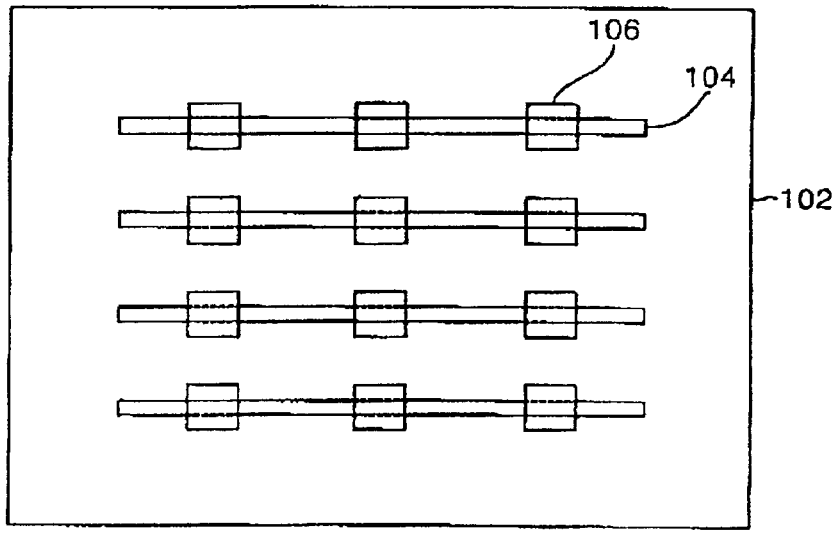
Figure 11C:
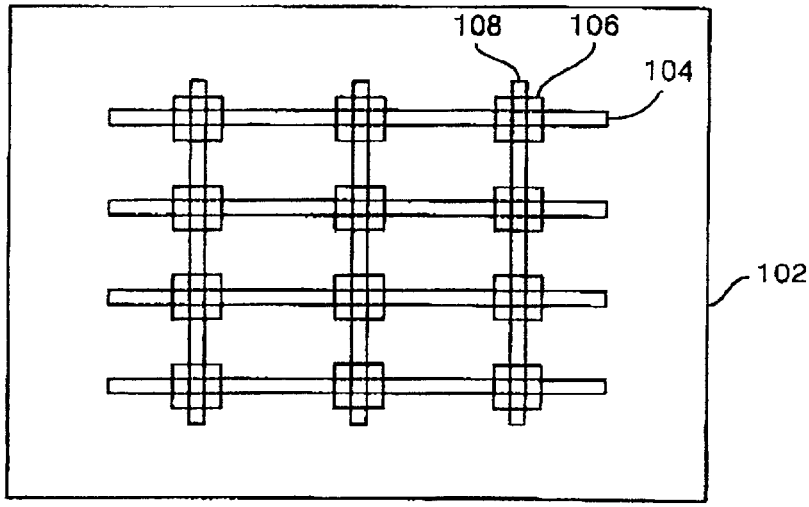
Figure 11D:
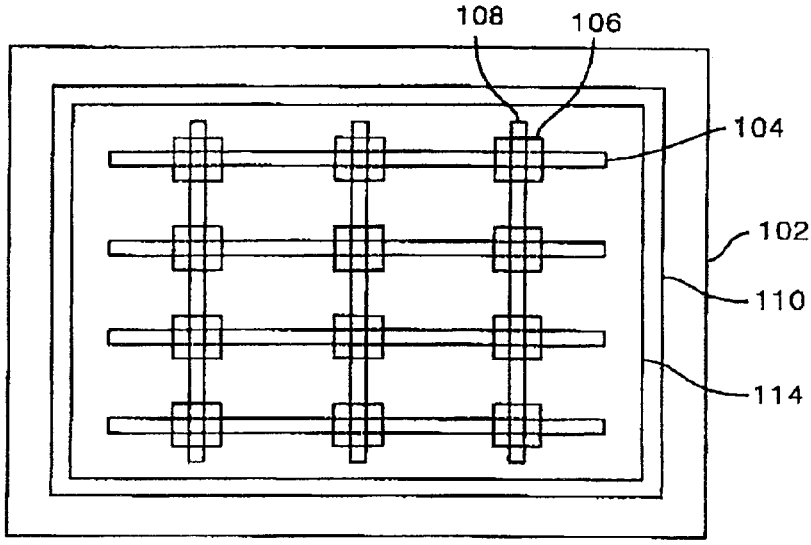

FIGS. 11A to 11D shows a method of fabricating a lower plate of the RFPDP in FIG. 9 step by step. Referring to FIG. 11A, the address electrode 104 is patterned in a line shape on the rear substrate 102 by means of the screen printing process or the photolithography. A mask pattern provided with a square pattern at a position corresponding to the center of the cell is aligned on the substrate 102 provided with the address electrode 104, and thereafter a dielectric material is coated thereon. Then, the dielectric pattern 106 with a square island shape as shown in FIG. 11B is formed at the center of the cell, data is, at a position corresponding to an intersection between the address electrode 104 and the scanning electrode 108. Subsequently, in FIG. 11C, the scanning electrode 108 is formed in a line shape on the dielectric pattern 106 in such a manner to cross the address electrode 104. On the rear substrate 102 provided with the address electrode 104 and the scanning electrode 108, as shown in FIG. 11D, the lower dielectric layer 110 is entirely coated. Finally, the protective film 114 is entirely deposited on the lower dielectric layer 110.

As described above, according to the present invention, a dielectric material is patterned in a line or island shape to exist only between the address electrode and the scanning electrode, thereby reducing the thickness of the dielectric material existing in the discharge path between the address electrode and the scanning electrode. Accordingly, a discharge voltage required for a discharge between the address electrode and the scanning electrode can be reduced to such an extent that the thickness of the dielectric material between the address electrode and the scanning electrode is reduced. As the discharge voltage is reduced, a driving circuit for generating the discharge voltage can be configured by low voltage devices. Furthermore, according to the present invention, a thickness of the dielectric material existing in the discharge path can not only be thinned to lower the discharge voltage, but also a thickness of the dielectric material existing between the address electrode and the scanning electrode can be thickened to reduce a leakage current between the address electrode and the scanning electrode.

Although the present invention has been explained by the embodiments shown in the drawings described above, it should be understood to the ordinary skilled person in the art that the invention is not limited to the embodiments, but rather that various changes or modifications thereof are possible without departing from thin spirit of the invention. Accordingly, the scope of the invention shall be determined only by the appended claims and their equivalents.

What is claimed is:

1. A plasma display panel, comprising;

a plurality of dielectric patterns formed on a substrate to have a convex surface;

a first electrode formed on the dielectric patterns and the substrate;

a second electrode for causing a discharge along with the first electrode; and a dielectric layer provided between the first and second electrodes to make an insulation between the first and second electrodes.

2. The plasma display panel as claimed in claim 1, wherein the first electrode has lands and grooves complying with a wave shape made by the surfaces of the dielectric patterns and the substrate.

3. The plasma display panel as claimed in claim 1, wherein the dielectric layer is entirely deposited on the substrate provided with the first electrode and the dielectric patterns to have a wave-shaped surface.

4. The plasma display panel as claimed in claim 1, wherein the first and second electrodes cross each other with having the dielectric layer therebetween.

5. The plasma display panel as claimed in claim 4, wherein each of the plurality of dielectric patterns is formed in a stripe shape in a direction parallel to the second electrode.

6. The plasma display panel as claimed in claim 1, wherein a width of the dielectric pattern is adjusted to control a discharge distance between the first and second electrodes.

7. The plasma display panel as claimed in claim 1, wherein the first electrode is an address electrode to which a data signal is applied, and the second electrode is a scanning electrode to which a scanning pulse synchronized with the data signal is applied.

8. The plasma display panel as claimed in claim 1, further comprising:

a radio frequency electrode coupled with a radio frequency signal to cause a discharge along with the second electrode.

9. A plasma display panel, comprising:

a first electrode formed on a substrate;

a second electrode crossing the first electrode to cause a discharge along with the first electrode;

a dielectric pattern located between the first and second electrodes for making an insulation between the first and second electrodes, wherein the dielectric pattern is formed in a striped shape; and a radio frequency electrode coupled with a radio frequency signal to cause a discharge along with the second electrode.

10. The plasma display panel as claimed in claim 9, wherein a thickness of the dielectric pattern is adjusted to control a leakage current between the first and second electrodes.

11. The plasma display panel as claimed in claim 9, wherein the dielectric pattern is formed in a striped shape running substantially parallel to the second electrodes.

12. The plasma display panel as claimed in claim 9, wherein the first electrode is an address electrode to which a data signal is applied, and the second electrode is a scanning electrode to which a scanning pulse synchronized with the data signal is applied.

13. The plasma display panel as claimed in claim 9, comprising:

an upper panel including said radio frequency electrode.

14. A plasma display panel, comprising:

a first electrode formed on a substrate;

a second electrode crossing the first electrode to cause a discharge along with the first electrode;

a dielectric pattern located between the first and second electrodes for making an insulation between the first and second electrodes, wherein the dielectric pattern has an island shape at an intersection between the first and second electrodes; and a radio frequency electrode coupled with a radio frequency signal to cause a discharge along with the second electrode.

15. The plasma display panel of claim 14, further comprising a dielectric layer coated entirely on the substrate provided with the first and second electrodes and the dielectric pattern.

16. The plasma display panel of claim 14, wherein the first electrode is an address electrode to which a data signal is applied, and the second electrode is a scanning electrode to which a scanning pulse synchronized with the data signal is applied.

17. A plasma display panel, comprising:

a first electrode formed on a substrate;

a second electrode crossing the first electrode to cause a discharge along with the first electrode;

a dielectric pattern located between the first and second electrodes, wherein the dielectric pattern is formed in a striped shape; and an upper panel including a radio frequency electrode.

* * * * *